US010168033B2

(12) United States Patent
Hildebrand

(10) Patent No.: US 10,168,033 B2
(45) Date of Patent: Jan. 1, 2019

(54) DOWNLIGHT

(71) Applicant: ZUMTOBEL LIGHTING GMBH, Lemgo (DE)

(72) Inventor: Benjamin Hildebrand, Lage (DE)

(73) Assignee: ZUMTOBEL LIGHTING GMBH, Lemgo (DE)

( * ) Notice: Subject to any disclaimer, the term of this patent is extended or adjusted under 35 U.S.C. 154(b) by 0 days.

(21) Appl. No.: 15/502,863

(22) PCT Filed: Oct. 21, 2015

(86) PCT No.: PCT/EP2015/074315
§ 371 (c)(1),
(2) Date: Feb. 9, 2017

(87) PCT Pub. No.: WO2016/062744
PCT Pub. Date: Apr. 28, 2016

(65) Prior Publication Data

US 2017/0234514 A1 Aug. 17, 2017

(30) Foreign Application Priority Data

Oct. 21, 2014 (DE) ..... 20 2014 105 017 U

(51) Int. Cl.
*F21V 15/00* (2015.01)
*F21V 21/04* (2006.01)
(Continued)

(52) U.S. Cl.
CPC ..... *F21V 21/047* (2013.01); *F21S 8/026* (2013.01); *F21V 17/14* (2013.01); *F21V 21/045* (2013.01)

(58) Field of Classification Search
CPC ..... F21V 17/00; F21V 17/005; F21V 17/16; F21V 17/162; F21V 17/164;
(Continued)

(56) References Cited

U.S. PATENT DOCUMENTS 3,672,932 A 6/1972 D'Augustine
5,465,199 A 11/1995 Bray et al.
(Continued)

FOREIGN PATENT DOCUMENTS

DE 20312886 1/1971
DE 2929190 1/1981
(Continued)

OTHER PUBLICATIONS

German search report in foreign priority application 20 2014 105 017.5 dated May 20, 2015.
(Continued)

*Primary Examiner* — Anh Mai
*Assistant Examiner* — Matthew Peerce
(74) *Attorney, Agent, or Firm* — Andrus Intellectual Property Law

(57) ABSTRACT

Disclosed is a downlight (100) comprising an annular mounting frame (50) to be mounted in the area of a ceiling mounting hole, and a light fixture (10) that is to be fastened to the mounting frame (50) and includes a luminaire head (30) thereon. The mounting frame (50) and the light fixture (10) are designed such that the light fixture (10) is fastened to the mounting frame (50) by twisting the former (10) relative to the latter (50), additional securing means being provided which prevent the light fixture (10) from being twisted in the unlocking direction in a mounted position.

9 Claims, 4 Drawing Sheets

(51) Int. Cl.
*F21S 8/02* (2006.01)
*F21V 17/14* (2006.01)

(58) Field of Classification Search
CPC ..... F21V 17/166; F21V 17/168; F21V 17/18; F21V 21/043; F21V 21/044; F21V 21/045; F21V 21/046; F21V 21/047
USPC ..... 362/365; 315/56
See application file for complete search history.

(56) References Cited

U.S. PATENT DOCUMENTS

| | | | | |
|---|---|---|---|---|
| 5,757,136 | A * | 5/1998 | Schadhauser | F21V 23/02 315/56 |
| 6,702,454 | B2 | 3/2004 | Grajetzky et al. | |
| 7,021,815 | B1 * | 4/2006 | Yang | H01R 33/09 362/652 |
| 8,950,885 | B2 | 2/2015 | Pieper | |
| 2011/0141741 | A1 | 6/2011 | Engstrom et al. | |
| 2013/0100676 | A1 | 4/2013 | Wang | |
| 2014/0160772 | A1 | 6/2014 | Wu | |
| 2014/0185302 | A1 | 7/2014 | Ebisawa | |

FOREIGN PATENT DOCUMENTS

| | | |
|---|---|---|
| DE | 8010194 | 6/1981 |
| DE | 19512130 | 10/1996 |
| DE | 19854669 | 6/2000 |
| DE | 10013087 | 9/2001 |
| DE | 202006000829 | 3/2006 |
| DE | 202010002646 | 7/2011 |

OTHER PUBLICATIONS

International Search Report in parent application PCT/EP2015/074315 dated Dec. 21, 2015.

* cited by examiner

DOWNLIGHT

CROSS REFERENCE TO RELATED APPLICATION

The present application is the U.S. national stage application of International Application PCT/EP2015/074315, filed Oct. 21, 2015, which international application was published on Apr. 28, 2016 as International Publication WO 2016/062744 A1. The International Application claims priority of German Patent Application 20 2014 105 017.5, filed Oct. 21, 2014.

FIELD OF THE INVENTION

The present invention relates to a downlight, having an annular mounting frame to be mounted in the region of a ceiling mounting hole, and a so-called light fixture to be attached to the mounting frame, having a luminaire head located thereon. In particular, the invention relates to a downlight with which the light fixture is releasably attached to the mounting frame by twisting it in relation thereto.

BACKGROUND OF THE INVENTION

Lamps that are provided for attachment to a ceiling of a room that is to be illuminated, which are designed to project light in a substantially downward direction are normally referred to as "downlights." These are normally recessed lamps, which are designed such that they can be mounted in the mounting holes of a suspended ceiling element, e.g. a sheetrock ceiling.

Recessed ceiling lamps of this type, in the form of downlights, are know in different configurations. A classic design comprises the lamp or the light fixture having the actual luminaire head, which then contains the light source(s), basically having a circular design. An annular, mounting frame is first attached to the ceiling, and the light fixture, having the luminaire head located thereon, is subsequently releasably attached to the mounting frame.

The use of this mounting frame serves to simplify the installation of the downlight, as well as later repair and maintenance measures. Specifically, only the mounting frame is permanently attached to the ceiling structure, e.g. via a screw connection or a special clamping connection, and subsequently, optionally, at least partially plastered over. The actual lamp, on the other hand, i.e. the light fixture having the luminaire head located thereon, is designed such that it can be attached to the mounting frame in a releasable manner. The actual installation of the main components of the downlight can thus occur at a later point in time, when all of the further preparations, in particular the attachment and plastering of the mounting frame, have already been completed. Furthermore, it is not necessary to fully remove all of the components in order to exchange the luminaire head, or the light source of the downlight, rather only the light fixture is released from the mounting frame and removed therefrom. The mounting frame itself, on the other hand, can remain permanently in the ceiling.

SUMMARY OF THE INVENTION

For the solution described above, it is necessary, as a matter of course, that the attachment of the light fixture to the mounting frame is releasable, while at the same time, the connection is designed such that the light fixture having the luminaire head located thereon can be easily, quickly and reliably attached to the mounting frame. In particular, with the rotational embodiments referred to in the present invention, attachment means in the form of a screw-like connection, and in particular a so-called bayonet joint, have been implemented. In these rotational embodiments, the light fixture is placed against the mounting frame from below and then twisted in relation thereto. The light fixture is then attached to the mounting frame by means of guide projections, which are normally disposed on the light fixture and engage in the guide tracks of the mounting frame, or slide along the surface of such guide tracks. In order to release the connection, the light fixture need only be twisted in the opposite direction in relation to the mounting frame.

This type of bayonet joint, described above, has proven to be very effective for downlights in many instances, but in some cases there is the problem that the light fixture attached to the mounting frame cannot be sufficiently secured. This problem exists in particular when the luminaire head retained by the light fixture can also be adjusted, and pivoted and/or rotated in relation thereto, for example. So-called Cardan lights are frequently used, in which the luminaire head can be rotated 360° in relation to the light fixture, and can also be pivoted. The mount for the luminaire head is designed in this case such that an adjustment of the luminaire head has no effect on the attachment of the light fixture to the mounting frame, but there is nevertheless the risk that when the luminaire head is twisted in one direction, which corresponds to the release of the bayonet joint, the connection between the light fixture and the mounting frame is simultaneously released unintentionally. This means that there is a risk that, when adjusting the orientation of the luminaire head, the light fixture is also unintentionally released and the lamp falls out of the mounting frame.

The present invention therefore addresses the objective of providing a novel solution in which the problems outlined above are avoided.

The downlight according to the invention is designed such that the attachment of the light fixture to the mounting frame occurs by twisting the light fixture in relation to the mounting frame. This can be provided, in particular, in the framework of a bayonet joint. In accordance with the invention, additional securing means are provided, which secure the light fixture against rotation in the releasing direction when the light fixture has been installed, i.e. is in the position in which it is attached to the mounting frame.

Thus, in accordance with the present invention, a downlight is proposed, having an annular mounting frame that is to be installed in the region of a ceiling mounting hole, and light fixture that is to be attached to the mounting frame, having a luminaire head located thereon, wherein the mounting frame and the light fixture are designed such that the attachment occurs by means of twisting the light fixture in relation to the mounting frame, and wherein, in accordance with the invention, additional securing means are provided, which secure the light fixture against twisting in the releasing direction when it has been installed.

The securing means preferably comprise a locking element, disposed in particular on the mounting frame, which is blocked, in particular, by a delimiting element disposed on the light fixture when the light fixture has been installed. It may be provided, in particular, that the locking element and the delimiting element are designed such that when the light fixture is twisted in relation to the mounting frame in the installation direction, the locking element automatically passes over, or overcomes the delimiting element. This can be achieved, for example, in that the delimiting element is formed by a so-called approach bevel, and the locking element is supported such that it can be adjusted in terms of its height. When the light fixture is twisted in relation to the mounting frame in order to attach it thereto, the height adjustable locking element slides along the approach bevel, and is deflected thereby, until it passes over it, and then snaps back in place, into a corresponding locking position, in which the locking element is blocked against a twisting in the opposite direction by the delimiting element, or the approach bevel. The solution according to the invention can be very easily implemented in this manner, without numerous additional measures.

The height adjustability of the locking element can be implemented, for example, in that the locking element is formed by a locking spring, which is disposed on the mounting frame, and has a locking projection facing the interior space intended for receiving the light fixture. The fact that this relates to a flexible element thereby also ensures that the locking spring automatically snaps into a position in which, according to the present invention, the light fixture is secured against rotation in the releasing direction after passing over the approach bevel.

The various components are preferably arranged such that an unintentional releasing of the locking according to the invention is prevented. This locking can only be released through targeted measures, for which it may be proposed, for example, that an unlocking hole is formed on the mounting frame, which enables the insertion of a tool for lifting the locking spring. By way of example, this hole can be very small, such that the locking can only be released by inserting a very thin object, e.g. a paper clip or a thin screwdriver, which must be inserted in this hole in a targeted manner. This measure provides, on one hand, sufficient security, and on the other hand, the effort required for releasing the lock is not very great, if the light fixture is to be intentionally removed from the mounting frame.

Another further development can comprise an additional delimiting projection, by means of which a twisting of the light fixture is limited in the locking direction. I.e., this delimiting projection represents the end position of the light fixture when it is rotated in order to install it, and is preferably disposed such that the locking projection of the locking spring specified above passes into the intermediate space between the delimiting projection and the approach bevel. By this means, a defined installation position of the light fixture in relation to the mounting frame is obtained.

The light fixture itself can be made of plastic, for example. It is also possible to make it out of another material, in particular sheet metal or aluminum.

As has already been stated, the solution according to the invention results in advantages when the luminaire head itself can also be adjusted, in particular such that it is disposed on the light fixture in an adjustable manner. I.e., a particularly preferred exemplary embodiment of the present invention depicts Cardan lamps. The concept according to the invention can, however, also be used with luminaire heads rigidly disposed on the light fixture.

BRIEF DESCRIPTION OF THE DRAWINGS

The invention shall be explained in greater detail below based on the attached drawings. Therein.

DETAILED DESCRIPTION

Figure 1:
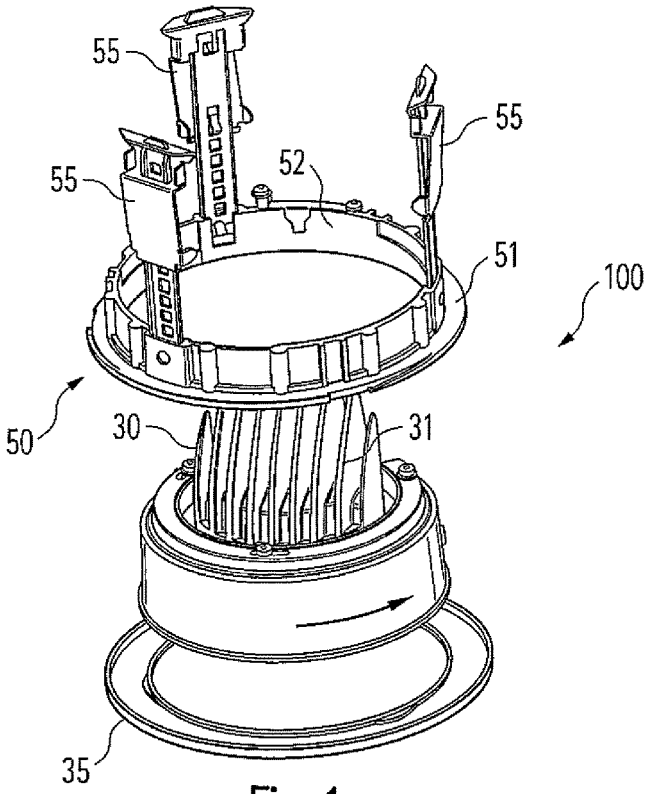
FIG. 1 shows the components of an exemplary embodiment of a downlight according to the invention in an exploded view.
Figure 2:
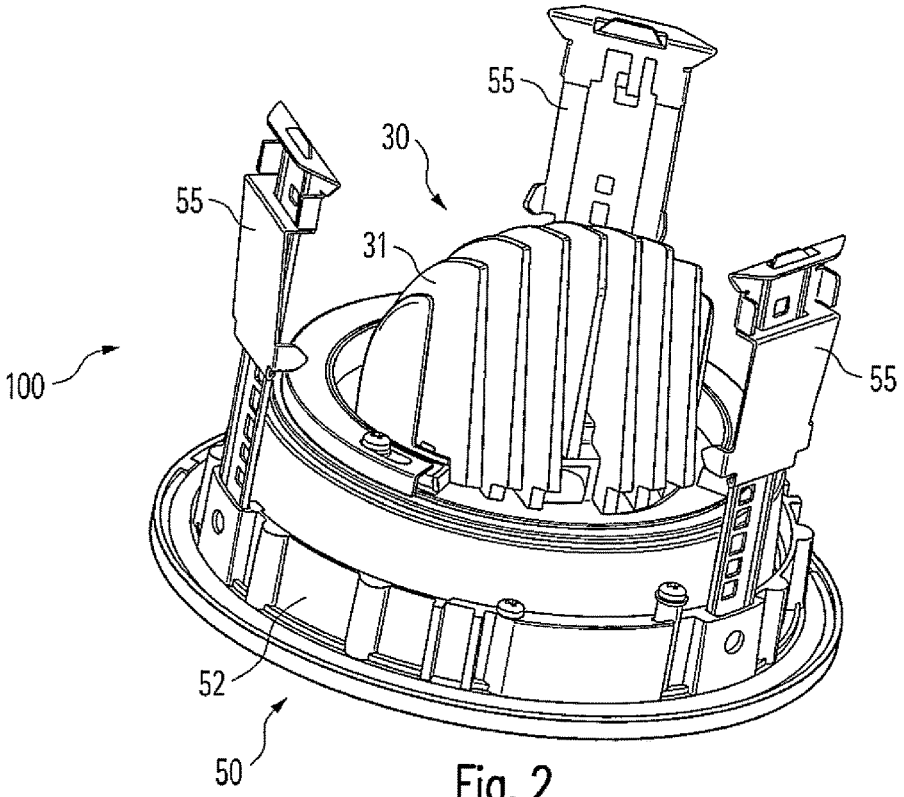
FIG. 2 shows the downlight according to FIG. 1 in the assembled state.

Initially, FIGS. 1 and 2 show different views of the main components of a downlight designed according to the invention, provided as a whole with the reference symbol 100. The downlight 100 is intended to be installed in a basically circular mounting hole, not shown here, in a suspended ceiling. Light emission occurs primarily in a downward direction, toward a region that is to be illuminated. There are many uses for downlights of this type, both for lighting workspaces as well in spaces in public buildings, e.g. museums and the like.

The attachment of such downlights to a ceiling construction occurs, such that initially, a first element is preferably permanently and securely connected to the ceiling, and all of the other components can be releasably mounted on this first element. An installation frame or mounting frame 50 is the element permanently connected to the ceiling, which is adapted to the mounting hole in the ceiling in terms of its shape, thus having a circular shape in the present case. As is already known from the prior art, the mounting frame 50 has an angled configuration, having a flange 51 directed outward, which bears against the ceiling in the installed state, as well as a circumferential ridge 52 extending through the hole in the ceiling. The circumferential flange region 51, which then forms the actual mounting hole for the other components of the downlight with its inner edge, serves to compensate for, or cover any irregularities in the ceiling mounting hole. This flange 51 is frequently partially plastered over after it has been attached to the ceiling, such that a particularly inconspicuous transition is obtained between the ceiling and the other elements of the lamp 100.

The attachment of such a mounting frame 50 to the suspended ceiling can be achieved by a number of methods, wherein screw connections are known, for example, which would also be suitable in the present case. In this case, the outward protruding region of the flange 51 normally has a hole pattern or the like, which simplifies the screwing to the sheetrock ceiling. In contrast, the attachment occurs with the depicted exemplary embodiment by means of special locking elements 55, which are distributed about the circumference of the mounting frame 50. These locking elements are formed, in particular, by height adjustable and outward pivotable tabs, which are first oriented vertically downward in the configuration depicted in FIG. 1, such that they can be easily inserted through the mounting hole when the mounting frame 50 is placed in the ceiling. The locking elements 55 are first pivoted outward and pressed down in the state in which the flange region 51 bears on the undersurface of the ceiling, such that they ultimately come to bear against the upper surface of the suspended ceiling. The ceiling is then therefore clamped between the locking elements 55 on one side, and the outward protruding flange region 51 of the mounting frame 50 on the other side, such that it is securely joined to the ceiling. Locking measures of this type are already known from downlights according to the prior art, for which reason there shall be no further description thereof.

The installation of the components responsible for light emission from the downlight 100 occurs in a second step. These are located in a luminaire head, which is provided with the reference symbol 30 in the present case. The luminaire head 30 contains, firstly, the light sources, e.g. in the form of one or more LEDs, the light of which is projected downward using a reflector, not shown in detail. The heat resulting during operation of the light sources is discharged into the ambient air through a cooling element 31, which extends upward—as shown in the illustration—and is disposed inside the intermediate region between the suspended ceiling and the structural ceiling above when in the installed state. The power supply for the various components of the luminaire head 30 can be provided by a separate control and power supply unit or an appropriate integrated unit.

The luminaire head 30 can thus have different designs, and for a releasable attachment to the mounting frame 50 it is retained by a light fixture 10, designed according to the invention in the manner described in greater detail below. In the present case, it is provided that the luminaire head 30 is disposed on the light fixture 10 such that it can be adjusted. In particular, a so-called Cardan light is to be created thereby, which enables a pivoting of the luminaire head 30 in different directions, and also enables a rotating thereof, in particular. Appropriate attachment means, which provide these types of adjustment possibilities, are already known from the prior art. Alternatively, it would also be entirely conceivable that the luminaire head 30 be retained on the light fixture 10 such that it can only be rotated, or it is even rigidly disposed thereon. Furthermore, an annular aperture 35 is also provided in the depicted exemplary embodiment, which is attached to the undersurface of the light fixture 10 for optical reasons. This is not absolutely necessary, however, for implementing the concept according to the invention.

Figure 3:
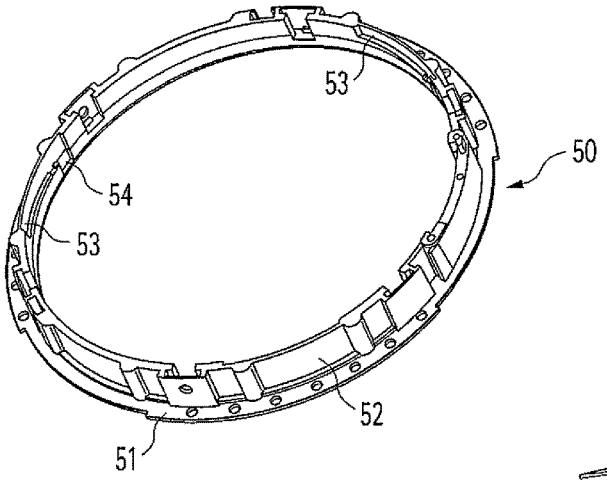
FIG. 3 shows the design of a mounting frame for the downlight.

The releasable attachment of the light fixture 10 to the mounting frame 50 occurs in the present case by means of a bayonet joint. This represents the typical approach for releasably attaching light fixtures for downlights to the annular mounting frames. Appropriate guide tracks 53 are provided on the inner surface of the upward directed ridge 52 of the mounting frame 50, which can be accessed via insertion holes 54, which extend toward the undersurface of the mounting frame 50. In the present case, three guide tracks 53 are distributed over the circumference of the mounting frame 50, having appropriate insertion holes 54 (see FIG. 3), wherein three projections corresponding thereto are distributed over the outer circumference of the light fixture 10. The light fixture, preferably made of plastic, has basically a pot-like design, having a circular base surface, to which the luminaire head 10 is attached, as well as a circumferential, slightly slanted, circumferential surface, on which the bayonet projections are formed.

In order to attach the light fixture 10 to the mounting frame 50, it is thus placed against the mounting frame 50 from below, such that the projections facing outward engage in the insertion holes 54. Subsequently, the light fixture 10 is twisted in the direction of the arrow (see FIG. 1), such that the projections slide along the upper surfaces of the guide tracks 53, until the end position, or installation position, has been reached. In this case, the guide tracks 53 then ensure that the light fixture 10 can no longer fall downward, out of the hole of the mounting frame 50.

If the arrangement of the luminaire head 30 on the light fixture 10 is then such that an adjustment of the light emission can be carried out through rotating, there is then the risk that when the luminaire head 30 is rotated against the direction of the arrow in FIG. 1, the light fixture 10 will also be rotated in this direction, and as a result, the bayonet lock will be unintentionally released. This would mean that there is the risk that when the light emission is adjusted, the connection between the mounting frame 50 and the light fixture 10 could be loosened unintentionally, or even fully released, such that it can fall out.

In order to prevent this, a special securing mechanism is provided according to the present invention, which shall be described in greater detail based on the following figures.

Figure 4:
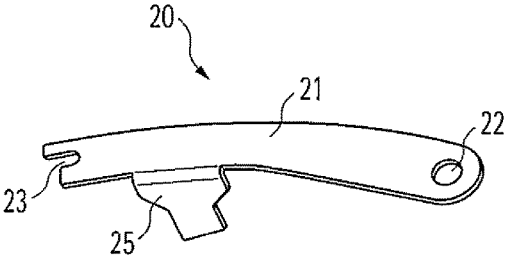
FIG. 4 shows the locking spring used as a locking element.

A first substantial element of the solution according to the invention represents a so-called locking spring, which is shown individually in FIG. 4, and is provided with the reference symbol 20. The arrangement of the locking spring on the mounting frame 50 can be seen more clearly from FIGS. 5 and 6.

As can be seen, the locking spring 20 has a slightly curved ridge 21, which has a horizontal orientation in later use, having a hole 22 on one end, and a guide recess 23 on the opposing end. There is a locking projection 25, extending at an angle to the ridge 21, which forms a pin facing downward, and initially tapers and then extends in a straight line. This projection 25 is disposed on a longitudinal side of the horizontal ridge 21, supported from the middle, basically in the direction of the guide recess 23. As a whole, the locking spring is formed by an appropriately stamped piece of sheet metal, which is later curved.

Figure 5:
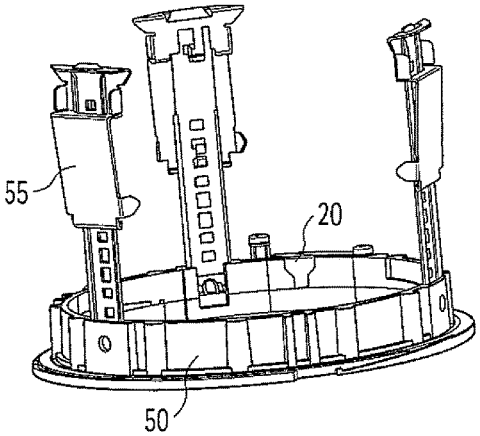
FIG. 5 shows the mounting frame with elements for attachment to a suspended ceiling located thereon.
Figure 6:
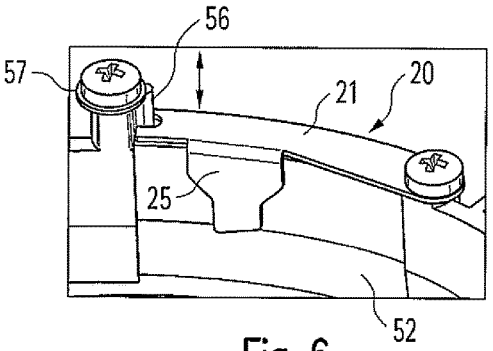
FIG. 6 shows an enlarged view of the locking spring attached to the mounting ring.

The arrangement of the locking spring 20 on the mounting frame 50 is shown in FIGS. 5 and 6. In particular, it can be seen that the spring is permanently connected to the upper edge of the circumferential ridge 52 of the mounting frame 50 via the hole 22 on the corresponding end by means of a screw connection—or some other means. The ridge 21 is not, however, attached on the opposite side, but rather, merely disposed there, such that a guide projection formed on the ridge 52 of the mounting frame 50 engages in the guide recess 23. This means that the corresponding end of the locking spring 20 can move up and down here, in the direction of the double arrow, which ultimately means that a vertical deflection of the locking projection 25 can occur. At the upper end of the guide projection 56 a height stop 57 is created by a disk secured with a screw, which delimits the potential deflection of the locking spring 20 in the upward direction, and secures it accordingly in the guide.

Figure 7:
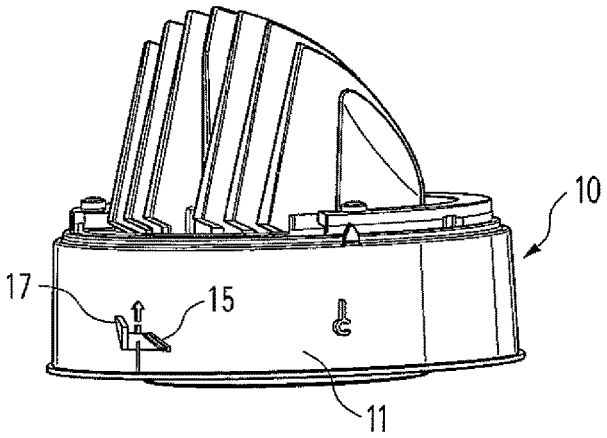
FIG. 7 shows the view of a light fixture having components thereon for implementing the securing against rotation according to the invention.
Figure 8:
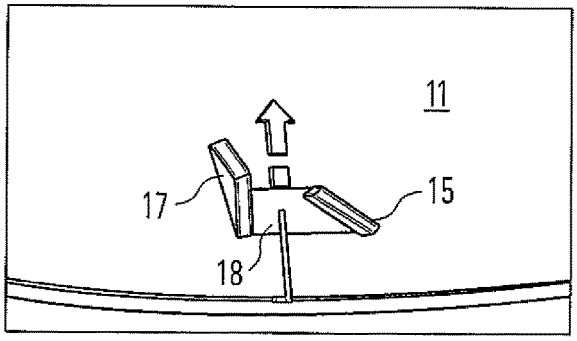
FIG. 8 shows an enlarged view of a portion of the light fixture from FIG. 7.

Elements interacting with this locking spring 20 are then provided on the outer circumference, or outer surface 11 of the light fixture 10, wherein these can be seen in particular from FIGS. 7 and 8. A slanted approach bevel 15, directed outward, is used here in particular, as well as an additional stop element 17 slightly spaced apart therefrom. The spacing between the two elements is dimensioned such that at least the lower end region of the locking projection 25 of the locking spring 20 can engage in the intermediate space 18. The two elements 15 and 17 are disposed on the outer circumference of the light fixture 10 with respect to their height such that when the spring 20 is not in the deflected state, in which the horizontal ridge 21 thus bears on the upper edge of the circumferential ridge 52 of the mounting frame 50, the lower end region of the locking projection 25 extends into the intermediate space 18.

Figure 9A:
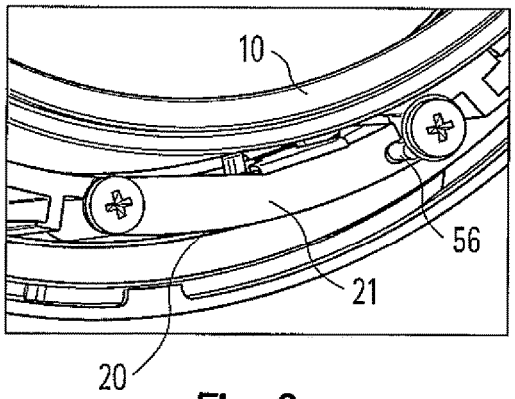
FIGS. 9*a* and 9*b* show the steps for attaching the light fixture to the mounting frame according to the present invention.
Figure 9B:
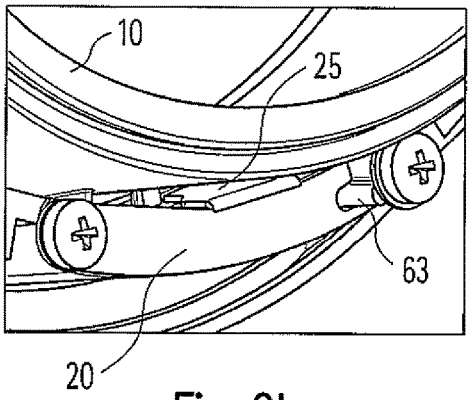

The interaction of the various elements can be retraced on the basis of FIGS. 9*a* and 9*b*, which show the attachment of the light fixture 10 to the mounting frame 50. The light fixture 10 is inserted from below into the mounting frame 50 in a first step, and twisted in order to produce the bayonet joint, as described above. The bayonet joint and the arrangement of the approach bevel 15, as well as the end stop 17 are coordinated to the one another, such that in the end state, the locking projection 25 engages in the intermediate region 18. When twisted in the installation direction, it is ensured by the slope of the approach bevel 15 that the locking projection 25 slides along the upper surface of this bevel 15 thereby, and as a result, the spring 20 is automatically deflected upward (see FIG. 9*a*). As soon as the projection 25 has passed over the upper end of the approach bevel 15, however, the springs bends, or snaps downward, and the locking projection 25 is locked in the intermediate region 18 between the approach bevel 15 and the end stop 17. A random twisting in the unlocking direction is then blocked in this case by the approach bevel 15.

Figure 10A:
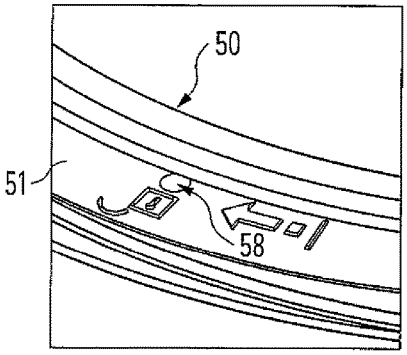
FIGS. 10*a* and 10*b* show the method for releasing the locking.
Figure 10B:
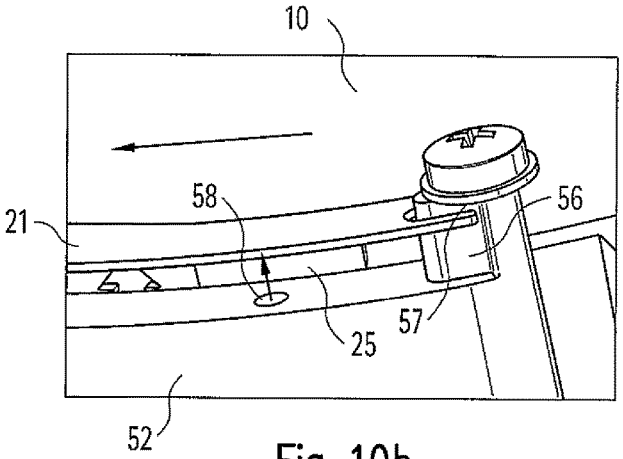

Obviously, the locking can only be released if the spring 20 is raised in a targeted manner, and the locking projection 25 is then released from the blocked position. A hole 58 is provided for this, in accordance with the illustrations in FIGS. 10*a* and 10*b*, which extends from the undersurface of the mounting frame 50, through the ridge 52, to its upper edge, and opens out toward the spring 20 in a region beneath the horizontal ridge 21, directly adjacent to the projection 25. I.e., if a pointed tool, e.g. a paper clip or a thin screwdriver, is inserted through the hole 58, the spring 20, in particular the locking projection 25, can be lifted slightly, as illustrated in FIG. 10*b*, and the safeguard can be released. At this point, the light fixture 10 can then be twisted in the direction of the arrow in order to release the bayonet joint. The height stop 57 ensures thereby that the locking spring 20 always remains in the guide for the projection 57, even when it is in the raised state.

Ultimately, a very simple but reliable securing of the light fixture to the mounting frame is enabled by means of the measures described herein. Because a simultaneous raising of the locking spring as well as a twisting of the light fixture is necessary to release the bayonet joint, preferably only one single locking spring is actually used. This provides, however, sufficient security for preventing an unintentional releasing of the light fixture when the beam characteristic of the lamp is adjusted, e.g. through rotating the luminaire head.

What is claimed is:

1. A downlight (100) comprising an annular mounting frame (50) that is to be installed through a ceiling mounting hole, and a light fixture (10) that is to be attached to the mounting frame (50) having a luminaire head (30) located thereon, wherein a circumferential ridge (52) on the annular mounting frame (50) extends upward in the ceiling mounting hole when the frame is installed, and wherein the mounting frame (50) and the light fixture (10) are designed such that the attachment occurs by twisting the light fixture (10) in relation to the mounting frame (50), and the downlight further comprises:

a locking element on the mounting frame, the locking element including a locking spring (20) mounted on a top surface of the circumferential ridge of the mounting frame and a locking projection (25) connected to the locking spring (20) and disposed angularly on a longitudinal side to the locking spring (20) and inside of an inner surface of the circumferential ridge (52) of the annular mounting frame;

a release hole (58) through the circumferential ridge (52) of the annular mounting frame (5) located underneath the locking spring (20) to provide access from below the mounting frame to push the locking spring upward; and a delimiting element (15) on an outer circumferential surface of the light fixture (10) that engages the locking projection (25) to secure the light fixture (10) against rotating in the unlocking direction when the light fixture (10) is twisted fully into an installed position but can be released by pushing the spring (20) upward using a tool through the release hole (58) to push the locking spring (20) and locking projection (25) upward from below the mounting frame (50).

2. The downlight according to claim 1 wherein a locking bayonet joint attaches the light fixture (10) to the mounting frame (50).

3. The downlight according to claim 1 wherein the delimiting element on the light fixture comprises an approach bevel (15).

4. The downlight according to claim 3 wherein the delimiting element on the light fixture also comprises a delimiting projection (17), which delimits a-rotation of the light fixture (10) in the locking direction.

5. The downlight according to claim 1 wherein the locking spring (20) is a curved flat spring with one end attached to the top surface of the circumferential ridge and with a guide recess 23 on the other end which is not attached to the top surface of the circumferential ridge, and wherein a guide projection (56) extends upward from the top surface of the circumferential ridge such that the guide recess fits over the guide projection and the guide projection enables vertical movement of the end of the locking spring with the guide recess, and the further wherein a height stop (57) is provided on a guide projection (56) to limit upward movement of the locking spring (20) on the mounting frame (50).

6. The downlight according to claim 1 wherein the light fixture (10) is made of plastic.

7. The downlight according to claim 1 wherein the luminaire head (30) is disposed on the light fixture (10) such that it can be rotated.

8. The downlight according to claim 1 wherein the locking spring (20) has a flat horizontal and curved portion with one end of the spring attached to the top surface of the circumferential ridge.

9. The downlight according to claim 1 wherein the locking spring and the locking projection of the locking element are made from an integral piece of stamped and bent sheet metal.

* * * * *